US007670182B2

(12) United States Patent
Morikawa

(10) Patent No.: US 7,670,182 B2
(45) Date of Patent: Mar. 2, 2010

(54) COAXIAL CONNECTOR WITH BUILT-IN CAPACITOR

(75) Inventor: Taishi Morikawa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 7 days.

(21) Appl. No.: 12/140,040

(22) Filed: Jun. 16, 2008

(65) Prior Publication Data

US 2008/0318470 A1 Dec. 25, 2008

(30) Foreign Application Priority Data

Jun. 20, 2007 (JP) ..... P2007-162225

(51) Int. Cl.
*H01R 13/66* (2006.01)

(52) U.S. Cl. ..... 439/620.03; 439/620.13

(58) Field of Classification Search ..... 439/620.03, 439/620.21, 620.09, 620.13
See application file for complete search history.

(56) References Cited

U.S. PATENT DOCUMENTS 5,094,629 A * 3/1992 Black et al. ..... 439/620.13
5,647,766 A * 7/1997 Nguyen ..... 439/620.09
5,730,612 A * 3/1998 Tatsuzuki ..... 439/188
6,019,622 A * 2/2000 Takahashi et al. ..... 439/188

FOREIGN PATENT DOCUMENTS

JP 2004-55426 2/2004

* cited by examiner

*Primary Examiner*—Hien Vu
(74) *Attorney, Agent, or Firm*—Finnegan, Henderson, Farabow, Garrett & Dunner, L.L.P.

(57) ABSTRACT

A coaxial connector with a built-in capacitor includes: a core wire connection terminal having, on a rear end thereof, a core wire connection portion for connecting thereto a core wire of a coaxial cable; an inner terminal having, on a tip end thereof, a fitted/connected portion fitted and connected to an other party's terminal; an insulator holding the inner terminal while covering an outer circumference of the inner terminal, and having a holding hole of the core wire connection terminal on a rear end thereof; a shield terminal having, on a tip end thereof, a cylindrical shell portion that covers an outer circumference of the insulator, and having, on a rear end thereof, a shield conductor crimping portion for crimping and connecting thereto a shield conductor of the coaxial cable; and an inner dielectric that is sandwiched between a tip end portion of the core wire connection terminal and a rear end portion of the inner terminal, and thereby composes a capacitor function portion while using, as opposite electrodes, the tip end portion of the core wire connection terminal and the rear end portion of the inner terminal.

5 Claims, 11 Drawing Sheets

COAXIAL CONNECTOR WITH BUILT-IN CAPACITOR

BACKGROUND OF THE INVENTION

1. Field of the Invention

The present invention relates to a coaxial connector with a built-in capacitor.

2. Description of the Related Art

As a conventional example of a coaxial connector with a built-in capacitor, the one shown in FIG. 1 and FIG. 2 is known (refer to Japanese Patent Laid-Open Publication No. 2004-55426 (FIG. 1, FIG. 6)).

This coaxial connector with a built-in capacitor is the one attached in advance onto a tip end of a coaxial cable 600 in order to connect the coaxial cable 600 to another party's cable (not shown). The coaxial cable 600 has a configuration, in which an outer circumference of a core wire 601 is covered with an insulator 602, an outer circumference of the insulator 602 is covered with a shield conductor 603 such as braided wires, and a protection coating 604 is provided on an outer circumference of the shield conductor 603.

This coaxial connector with a built-in capacitor includes: a capacitor 550 with attached lead wires, in which a pair of lead wires 552 and 553 are extended from a capacitor body 551 in opposite directions; an inner terminal 530 having, on a tip end thereof, a fitted/connected portion 531 with an attached spring 532, which is fitted and connected to an other party's terminal, and having, on a rear end thereof, a crimping portion 534 that crimps and connects the lead wire 552 as one of the pair in the capacitor 550 with attached lead wires; an insulator 520 having a terminal housing chamber 521 that houses and holds the inner terminal 530; a shield terminal 510 having, on a tip end thereof, a cylindrical shell portion 511 that covers an outer circumference of the insulator 520, and having, on a rear end thereof, a shield conductor crimping portion 512 for crimping and connecting thereto the shield conductor 603 of the coaxial cable 600; and a bundle crimping member 560 that crimps, as a bundle, the lead wire 553 as the other of the pair in the capacitor 550 with attached lead wires, and the core wire 601 of the coaxial cable 600.

In order to assemble the coaxial connector with a built-in capacitor, first, the lead wire 553 as one of the pair in the capacitor 550 with attached lead wires and the core wire 601 of the coaxial cable 600 are crimped as a bundle by the bundle crimping member 560, and the lead wire 552 as the other of the pair in the capacitor 550 with attached lead wires is crimped to the crimping portion 534 of the inner terminal 530. Thereafter, the inner terminal 530 is inserted into the terminal housing chamber 521 of the insulator 520 attached in advance into the shell portion 511 of the shield terminal 510, and the shield conductor 603 of the coaxial cable 600 is crimped to the shield conductor crimping portion 512 of the shield terminal 510. In such a manner as described above, a coaxial connector with a built-in capacitor, which has a configuration shown in FIG. 2, can be obtained.

SUMMARY OF THE INVENTION

As described above, in the conventional coaxial connector with a built-in capacitor, the capacitor 550 in which the lead wires 552 and 553 are attached onto both ends is used. Accordingly, when the coaxial connector is assembled, work of crimping each of the two lead wires 552 and 553 of the capacitor 550 is required to be performed twice, leading to a disadvantage in productivity.

In consideration for the above-described circumstances, it is an object of the present invention to provide a coaxial connector with a built-in capacitor, which is adapted to achieve enhancement of the productivity by simplifying an assembly process.

A first aspect of the present invention is a coaxial connector with a built-in capacitor, including: a core wire connection terminal having, on a rear end thereof, a core wire connection portion for connecting thereto a core wire of a coaxial cable; an inner terminal having, on a tip end thereof, a fitted/connected portion fitted and connected to an other party's terminal; an insulator holding the inner terminal while covering an outer circumference of the inner terminal, and having a holding portion of the core wire connection terminal on a rear end thereof; a shield terminal having, on a tip end thereof, a cylindrical shell portion that covers an outer circumference of the insulator, and having, on a rear end thereof, a shield conductor crimping portion for crimping and connecting thereto a shield conductor of the coaxial cable; and an inner dielectric that is sandwiched between a tip end portion of the core wire connection terminal and a rear end portion of the inner terminal, and thereby composes a capacitor function portion while using, as opposite electrodes, the tip end portion of the core wire connection terminal and the rear end portion of the inner terminal.

In accordance with such a configuration as described above, the capacitor function portion can be composed only by sandwiching the inner dielectric between the core wire connection terminal and the inner terminal. Accordingly, a capacitor with attached leads does not have to be used, and work and labor for electrical connection of the leads can be reduced, whereby enhancement of productivity can be achieved. Moreover, since the capacitor function portion is incorporated in an inside of the connector, it is possible to miniaturize the connector, and the connector is easy to handle. Moreover, a material (dielectric constant) of the inner dielectric and a thickness (inter-electrode distance) of a portion of the inner dielectric, which is sandwiched between the core wire connection terminal and the inner terminal, can be changed easily. Accordingly, a capacity of the capacitor can be changed easily.

Moreover, in the above-described configuration, a configuration may be further adopted, in which the inner dielectric is attached onto the tip end of the core wire connection terminal, the core wire connection terminal is inserted into the holding portion of the insulator, and the inner dielectric provided on the tip end of the core wire connection terminal is made to abut on the rear end portion of the inner terminal, whereby the inner dielectric is sandwiched between the tip end portion of the core wire connection terminal and the rear end portion of the inner terminal, and opposite surfaces of the tip end portion of the core wire connection terminal and the rear end portion of the inner terminal, which are opposite to each other while interposing the inner dielectric therebetween, become electrode surfaces of the capacitor.

In accordance with the configuration described above, the capacitor function portion can be composed only in such a manner that the core wire connection terminal in which the inner dielectric is attached onto the tip end is inserted into the holding portion on the rear end of the insulator, and that the inner dielectric is made to abut on the rear end portion of the inner terminal. Accordingly, the coaxial connector is easy to assemble, and enhancement of the productivity can be achieved.

Furthermore, in the above-described configuration, a configuration may be further adopted, in which the inner dielectric forms a shape in which a large-diameter collar portion is provided on an outer circumference of a small-diameter shaft portion, the shaft portion is inserted into a cylindrical portion as the tip end of the core wire connecting terminal, whereby the inner dielectric is attached onto the tip end of the core wire connection terminal in a state where the collar portion is disposed on an end surface of the cylindrical portion, and the collar portion is sandwiched by the end surface of the cylindrical portion of the core wire connection terminal and an end surface of a cylindrical portion as the rear end of the inner terminal, whereby the capacitor function portion is composed of the inner dielectric while using the end surfaces of both of the cylindrical portions as the electrode surfaces.

In accordance with the configuration described above, the shaft portion is inserted into the cylindrical portion of the core wire connection terminal, whereby the inner dielectric is attached onto the tip end of the core wire connection terminal. Accordingly, the inner dielectric and the core wire connection terminal can be assembled easily, and the inner dielectric can be fixed to the core wire connection terminal in a stable state. Moreover, it is also possible to mold the inner dielectric by inserting the core wire connection terminal into a metal die. In such a way, the productivity can be further enhanced. Furthermore, by the fact that the inner dielectric is attached in advance onto the tip end of the core wire connection terminal, the capacitor function portion can be composed only by inserting the core wire connection terminal into the holding portion on the rear end of the insulator. Accordingly, the coaxial connector can be assembled more easily.

Furthermore, in the above-described configuration, a configuration may be further adopted, in which a center hole that is along an axial direction of the inner dielectric is formed in the inner dielectric, a small-diameter shaft portion of a metal-made electrode member with a shape in which a large-diameter collar portion is provided on an outer circumference of the small-diameter shaft portion is fitted into the center hole in a state where the small-diameter shaft portion is brought into intimate contact with the center hole, the collar portion of the electrode member is superposed on the collar portion of the inner dielectric, and the collar portion of the inner dielectric and the collar portion of the electrode member are sandwiched by the end surface of the cylindrical portion of the core wire connection terminal and the end surface of the cylindrical portion as the rear end of the inner terminal in a state where the collar portion of the electrode member is superposed on the collar portion of the inner dielectric, whereby the capacitor function portion is composed of the inner dielectric while using, as the electrode surfaces, contact surfaces of the electrode member and the core wire connection terminal with the inner dielectric.

In accordance with the configuration described above, contact areas between the inner dielectric and members which become the electrodes can be increased, and accordingly, a capacity of the capacitor can be enhanced.

Furthermore, in the above-described configuration, a configuration may be further adopted, in which conductive films are formed on contact surfaces of the inner dielectric with the members which become the electrodes.

In accordance with the configuration described above, conductive states of the contact surface between the inner dielectric and the core wire connection terminal and of the contact surface between the inner dielectric and the inner terminal can be maintained well, and accordingly, the capacity of the capacitor can be increased.

Furthermore, in the above-described configuration, a configuration may be further adopted, in which surfaces of the inner dielectric, which contact the tip end portion of the core wire connection terminal and the rear end portion of the inner terminal, are formed as surfaces substantially parallel to a connector fitting direction.

In accordance with the configuration described above, it becomes easy to calculate the capacity of the capacitor. Moreover, large contact areas between the inner dielectric and the core wire connection terminal and between the inner dielectric and the inner terminal can be ensured. Accordingly, the capacity of the capacitor can be increased.

BRIEF DESCRIPTION OF THE DRAWINGS

FIG. 13A is an exploded perspective view of the inner dielectric and the electrode member; and FIG. 13B is a perspective view of an assembled state thereof.

FIG. 15A is a perspective view thereof; and FIG. 15B is a cross-sectional view thereof.

DETAILED DESCRIPTION OF THE EMBODIMENT

A description will be made of an embodiment of the present invention with reference to the drawings.

Figure 1:
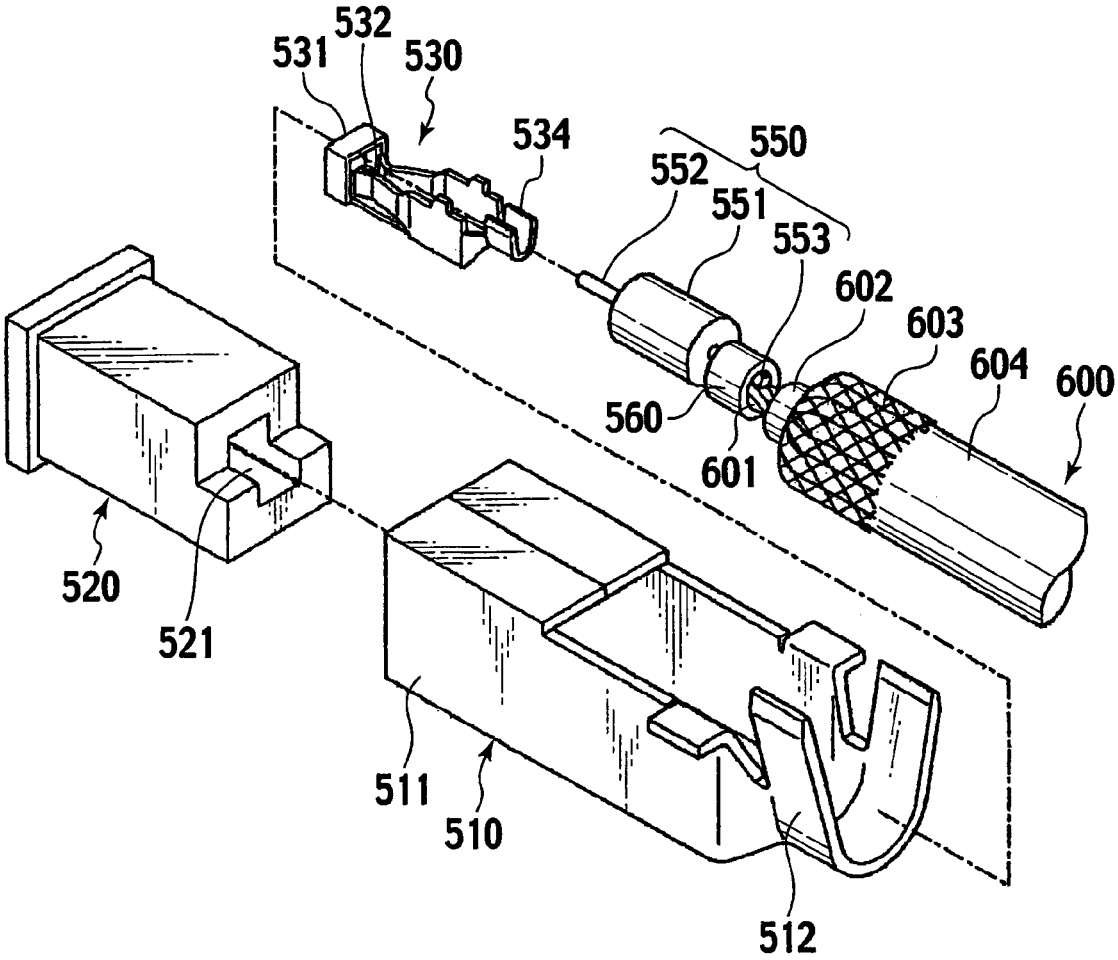
FIG. 1 PRIOR ART
FIG. 1 is a perspective view of a conventional coaxial connector with a built-in capacitor.
Figure 2:
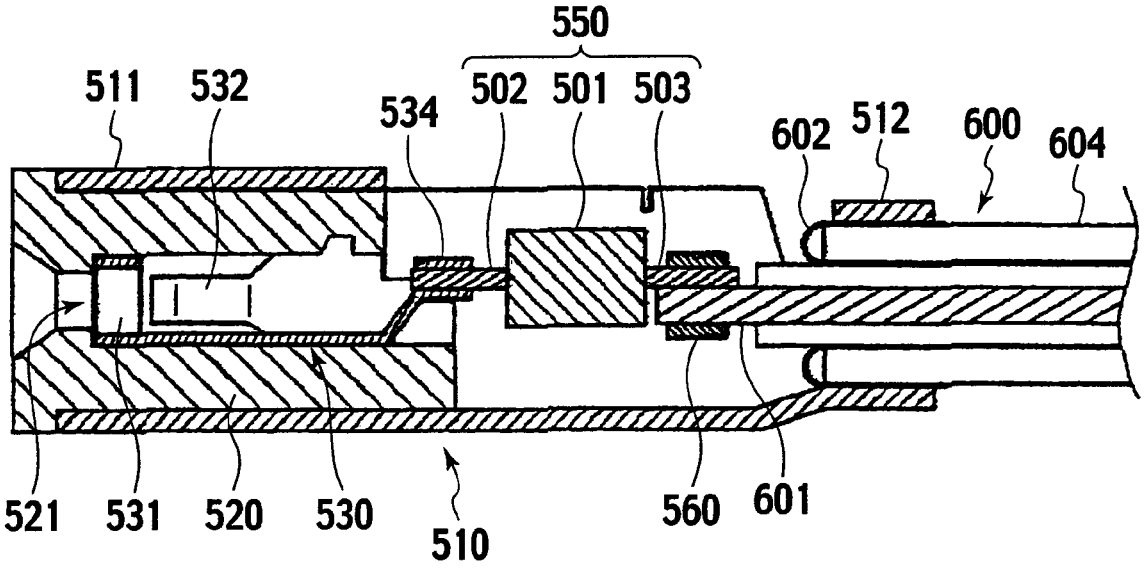
FIG. 2 PRIOR ART
FIG. 2 is a cross-sectional view of the conventional coaxial connector in an assembled state.

As shown in FIG. 3 to FIG. 11, a coaxial connector 1 with a built-in capacitor according to this embodiment basically includes: a core wire connection terminal 50 having, on a rear end thereof, a core wire connection portion 52 for connecting thereto the core wire 601 (refer to FIG. 1 and FIG. 2) of the coaxial cable 600; a metal-made inner terminal 30 having, on a tip end thereof, a fitted/connected portion 31 with an attached spring 32, which is fitted and connected to an other party's terminal (not shown); an insulator 20 made of a synthetic resin molded article having, on a tip end side thereof, a terminal holding chamber 21 with an attached terminal holding hole 22 for holding an inner terminal 30 while covering an outer circumference of the inner terminal 30 concerned, and having, on a rear end side thereof, a holding hole (holding portion) 23 and a core wire connection terminal protection piece 24, which are for inserting the core wire connection terminal 50 therethrough; a metal-made shield terminal 10 having, on a tip end side thereof, a cylindrical shell portion 11 that covers an outer circumference of the insulator 20, and having, on a rear end thereof, a shield conductor crimping portion 12 for crimping and connecting thereto the shield conductor 603 (refer to FIG. 1 and FIG. 2) of the coaxial cable 600; and an inner dielectric 40 that is sandwiched between a tip end portion of the core wire connection terminal 50 and a rear end portion of the inner terminal 30, and thereby composes a capacitor function portion 100 while using, as opposite electrodes, the tip end portion of the core wire connection terminal 50 and the rear end portion of the inner terminal 30.

Figure 8:
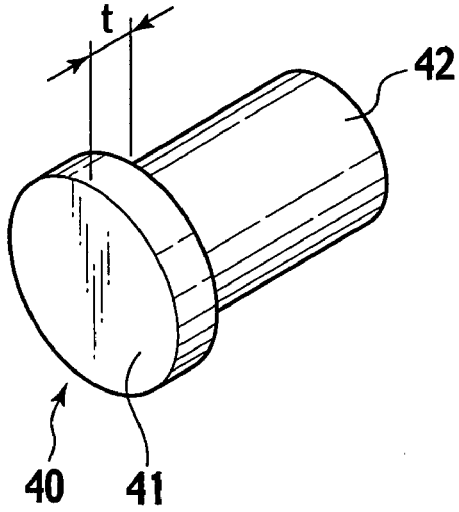
FIG. 8 is a perspective view showing only a configuration of the inner dielectric.
Figure 9:
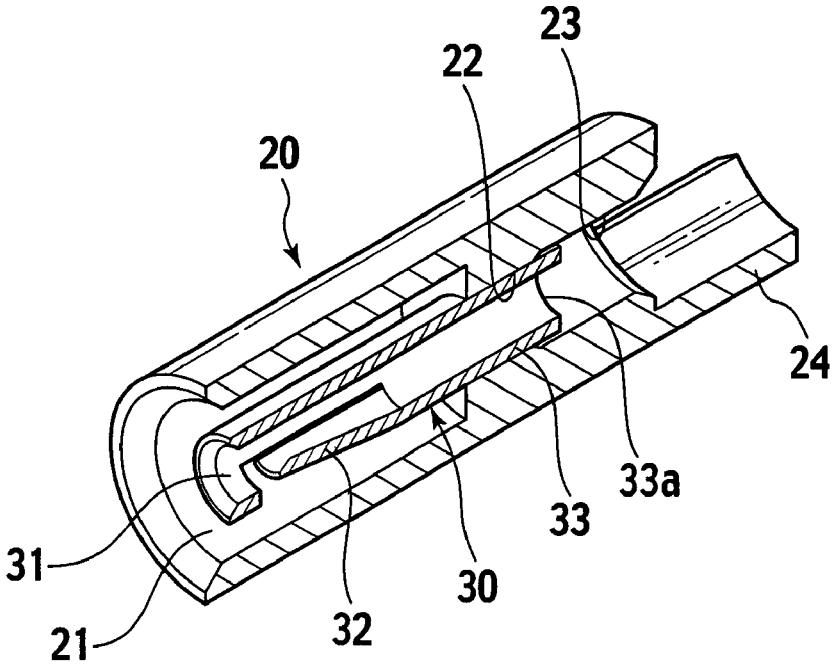
FIG. 9 is a perspective view showing a component in which an inner terminal is incorporated into an insulator as a constituent of the coaxial connector according to the embodiment.
Figure 10:
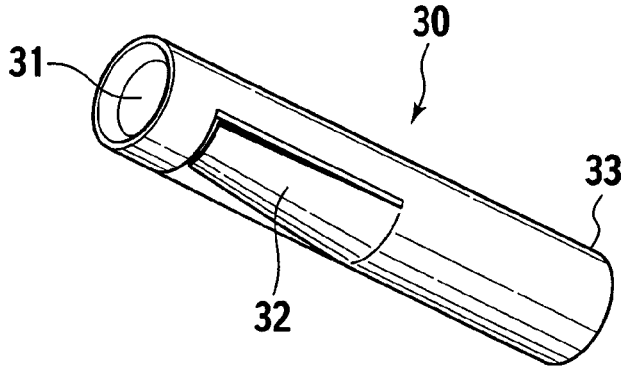
FIG. 10 is a perspective view showing only a configuration of the inner terminal.
Figure 11:
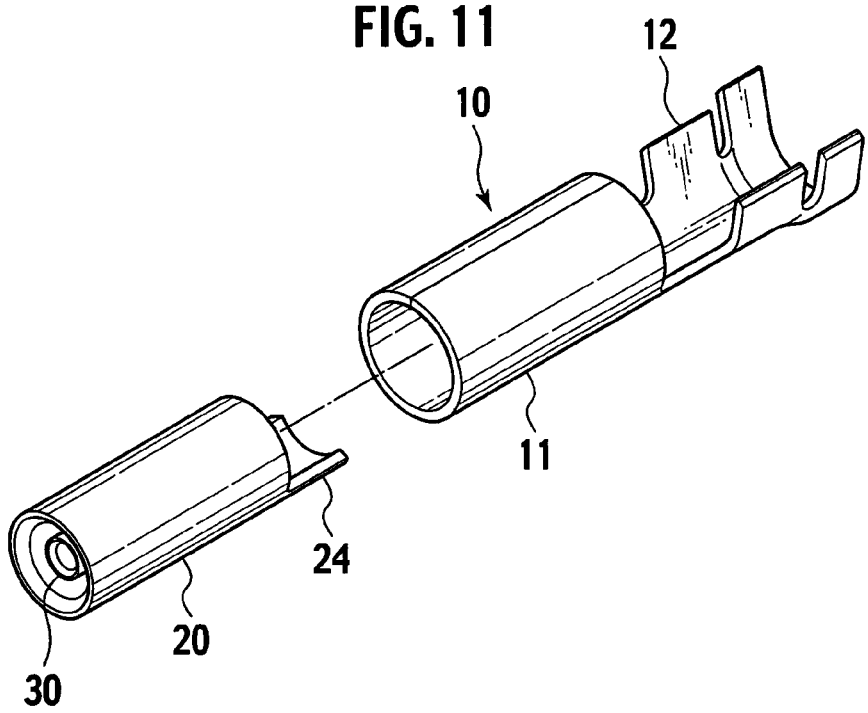
FIG. 11 is a perspective view showing a state where the component shown in FIG. 9 is going to be incorporated into a shield terminal.

As shown in FIG. 8, the inner dielectric 40 forms a shape in which a large-diameter collar portion 41 is provided on an outer circumference of a small-diameter shaft portion 42. In the illustrated example, an outer circumferential portion of a large-diameter head portion of the inner dielectric 40 corresponds to the collar portion; however, the collar portion may be provided on a middle of the shaft portion. As shown in FIGS. 4A and 4B, FIG. 6 and FIG. 7, the shaft portion 42 is inserted into a cylindrical portion 51 as a tip end of the core wire connection terminal 50, whereby the inner dielectric 40 is attached onto the tip end of the core wire connection terminal 50 in a state where the collar portion 41 is disposed on an end surface 51*a* of the cylindrical portion 51.

Figure 3:
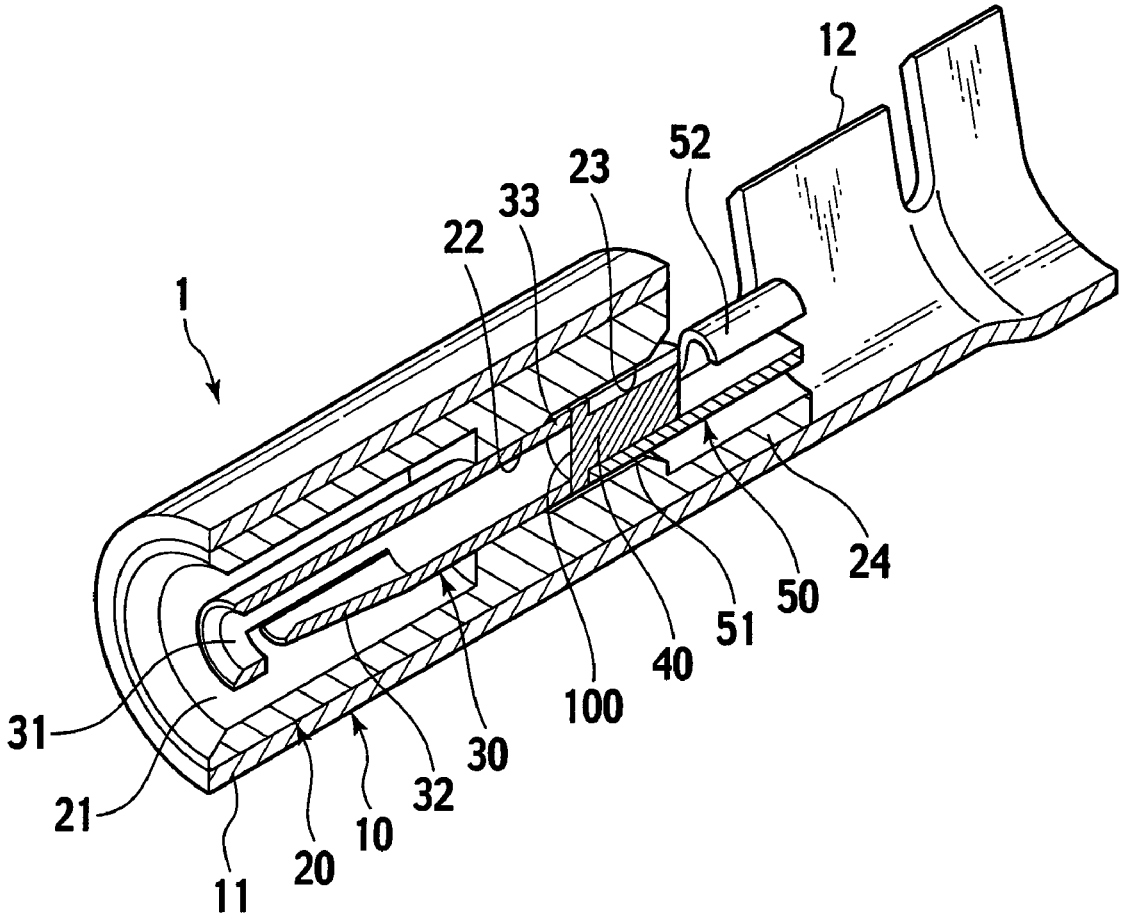
FIG. 3 is a perspective view showing a cross section longitudinally cut along a center of a coaxial connector with a built-in capacitor according to an embodiment of the present invention.
Figure 4A:
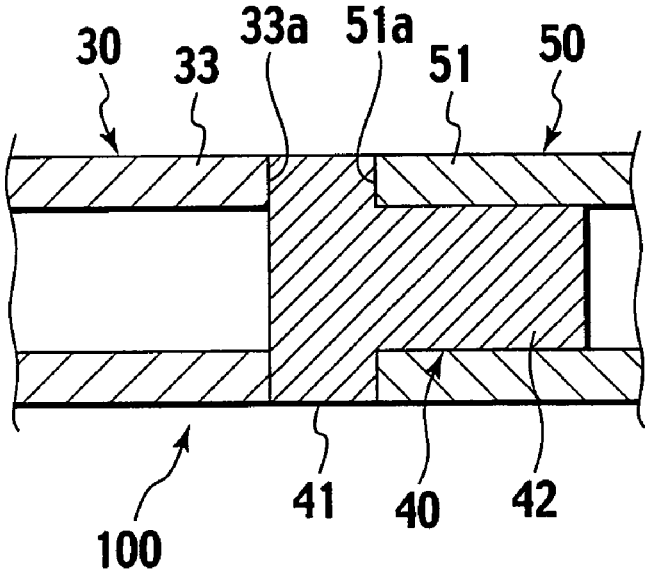
FIG. 4A is a cross-sectional view enlargingly showing a configuration of a capacitor function portion in the coaxial connector according to the embodiment.
Figure 4B:
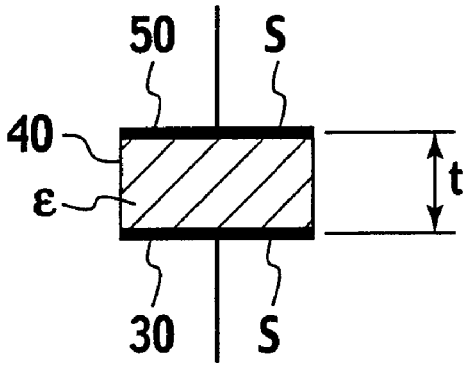
FIG. 4B is a schematic view of a capacitor made by the capacitor function portion.
Figure 5:
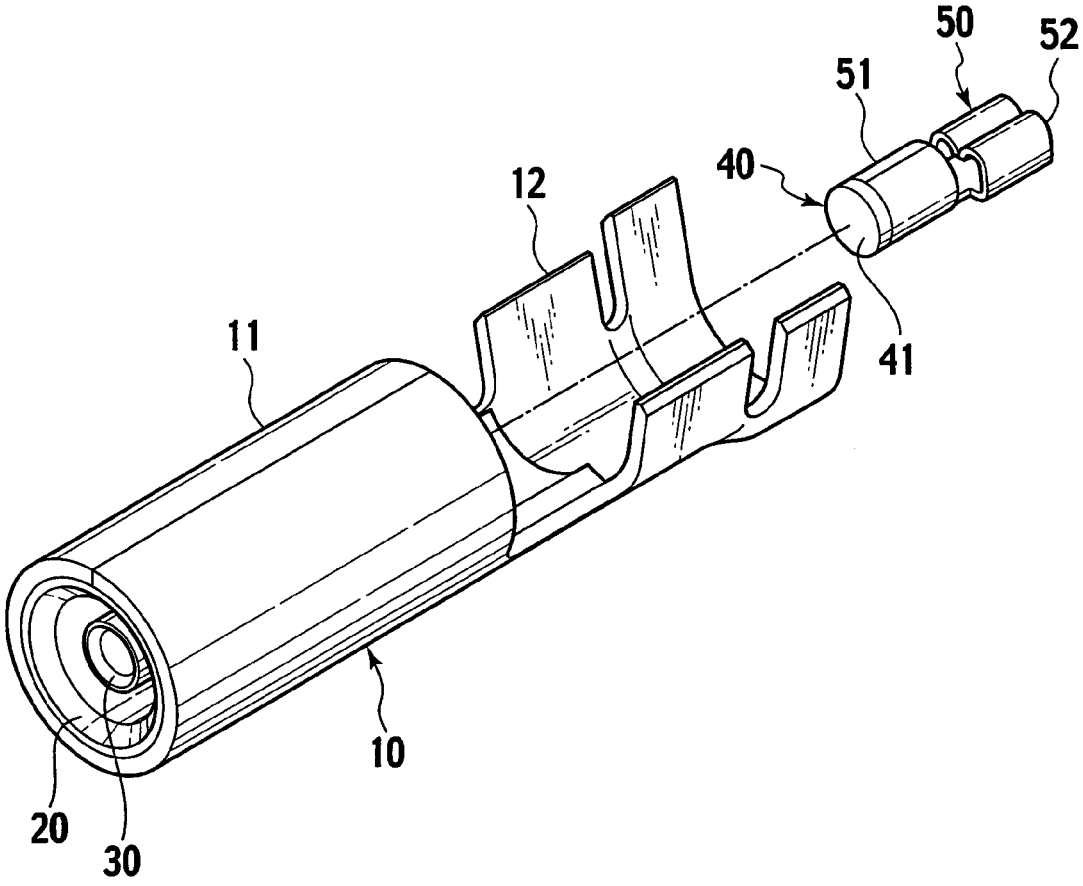
FIG. 5 is a perspective view showing a state of the coaxial connector according to the embodiment before being subjected to a final assembly process.
Figure 6:
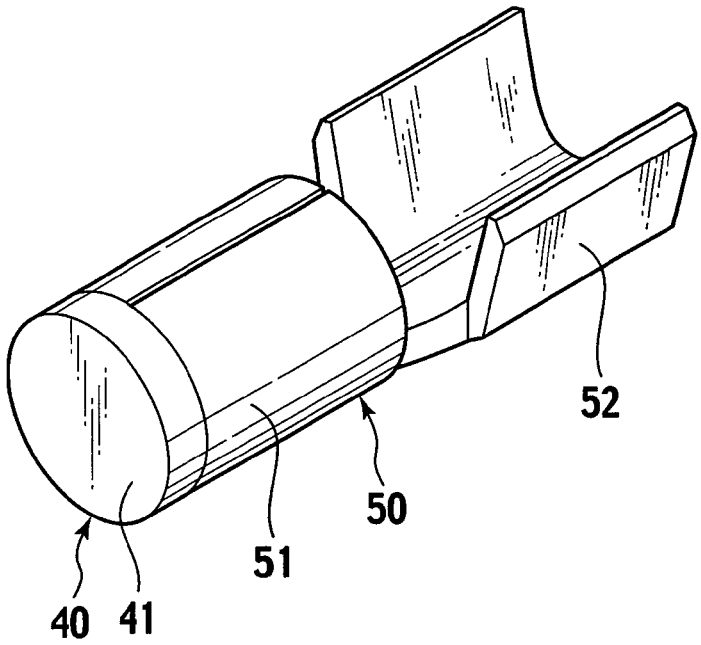
FIG. 6 is a perspective view of a core wire connection terminal in which an inner dielectric as a constituent of the coaxial connector according to the embodiment is attached onto a tip end.
Figure 7:
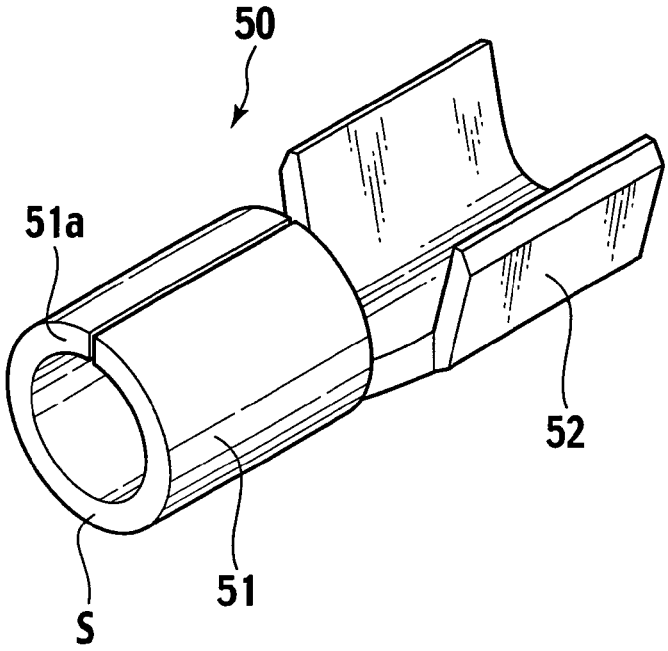
FIG. 7 is a perspective view showing only a configuration of the core wire connection terminal.

Then, as shown in FIG. 3 to FIG. 5, the core wire connection terminal 50 in which the inner dielectric 40 is attached onto the tip end is inserted into the holding hole 23 on the rear end of the insulator 20. The collar portion 41 of the inner dielectric 40 provided on the tip end of the core wire connection terminal 50 is made to abut on an end surface 33*a* of a cylindrical portion 33 as the rear end of the inner terminal 30 built in the insulator 20 in advance. In such a way, opposite surfaces of the tip end portion of the core wire connection terminal 50 and the rear end portion of the inner terminal 30, which are opposite to each other while interposing the collar portion 41 of the inner dielectric 40 therebetween, become electrode surfaces of the capacitor.

Specifically, as shown in FIG. 4A, the collar portion 41 of the inner dielectric 40 is sandwiched by the end surface 51*a* of the cylindrical portion 51 of the core wire connection terminal 50 and the end surface 33*a* of the cylindrical portion 33 as the rear end of the inner terminal 30. The end surfaces 51*a* and 33*a* of both of these cylindrical portions 51 and 33 become the electrode surfaces, whereby the capacitor function portion 100 is composed of the inner dielectric 40.

Here, as shown in FIG. 4B, an area (electrode area) of the end surface 50*a* of the cylindrical portion 51 of the core wire connection terminal 50 and the end surface 33*a* of the cylindrical portion 33 of the inner terminal 30, which compose the electrode surfaces, is defined as S. Moreover, a thickness (inter-electrode distance) of the collar portion 41 of the inner dielectric 40 sandwiched between the electrode surfaces is defined as t. Then, an electrostatic capacitance C of the capacitor (capacitor function portion 100) can be obtained by the following expression, where ∈ is a dielectric constant of the inner dielectric 40:

$$C=8.855\times10^{-12}\times(\in\cdot S/t)$$

As described above, the capacitor function portion 100 can be composed only by sandwiching the inner dielectric 40 between the core wire connection terminal 50 and the inner terminal 30. Accordingly, a capacitor with attached leads does not have to be used as in the conventional case, and work and labor for electrical connection of the leads can be reduced, whereby enhancement of productivity can be achieved. Moreover, since the capacitor function portion 100 is incorporated in an inside of the connector, it is possible to miniaturize the connector, and the connector is easy to handle. Moreover, a material (dielectric constant ∈) of the inner dielectric 40 and the thickness (inter-electrode distance) t of the portion (collar portion 41) sandwiched between the core wire connection terminal 50 and the inner terminal 30 can be changed easily. Accordingly, a capacity of the capacitor can be changed easily.

Moreover, the capacitor function portion 100 can be composed only in such a manner that the core wire connection terminal 50 in which the inner dielectric 40 is attached onto the tip end is inserted into the holding hole 23 on the rear end of the insulator 20, and that the inner dielectric 40 is made to abut on the rear end portion of the inner terminal 30. Accordingly, the coaxial connector is easy to assemble, and the enhancement of the productivity can be achieved.

Furthermore, the shaft portion 42 is inserted into the cylindrical portion 51 of the core wire connection terminal 50, whereby the inner dielectric 40 is attached onto the tip end of the core wire connection terminal 50. Accordingly, the inner dielectric 40 and the core wire connection terminal 50 can be assembled easily, and the inner dielectric 40 can be fixed to the core wire connection terminal 50 in a stable state.

Note that it is also possible to mold the inner dielectric 40 by inserting the core wire connection terminal 50 into a metal die. In such a way, the productivity can be further enhanced.

Moreover, by the fact that the inner dielectric 40 is attached in advance onto the tip end of the core wire connection terminal 50, the capacitor function portion 100 can be composed only be inserting the core wire connection terminal 50 into the holding hole 23 on the rear end of the insulator 20. Accordingly, the coaxial connector can be assembled more easily.

Next, a description will be made of a modification example of the inner dielectric 40.

Figure 12:
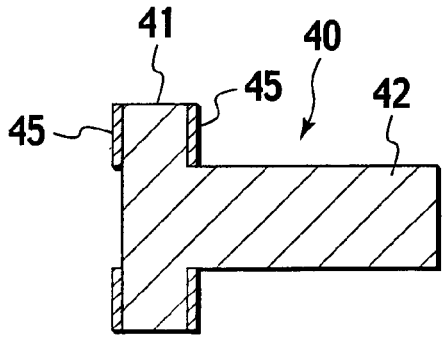
FIG. 12 is a cross-sectional view showing a modification example of the inner dielectric.

FIG. 12 is a view showing the modification example of the inner dielectric 40. As shown in this drawing, conductive films 45 are formed in advance by deposition and the like on the contact surfaces of the inner dielectric 40 with the members (the inner terminal 30 and the core wire connection terminal 50 in the above-described embodiment), which become the electrodes. Then, conductive states of the contact surface between the inner dielectric 40 and the core wire connection terminal 50 and of the contact surface between the inner dielectric 40 and the inner terminal 30 can be maintained well, and accordingly, the capacity of the capacitor can be increased.

Figure 13A:
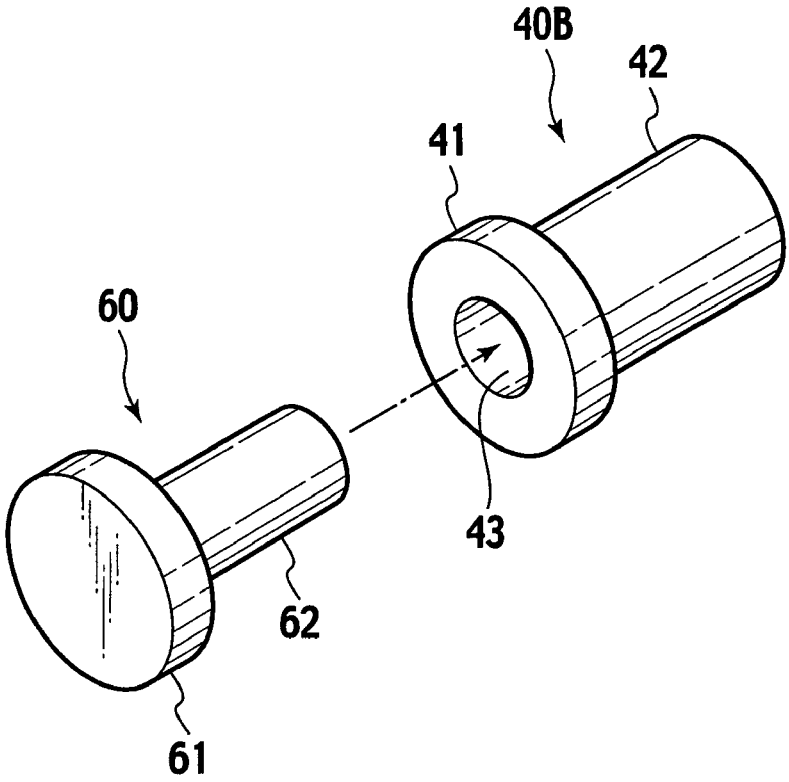
FIGS. 13A and 13B are views showing a relationship between an inner dielectric and an electrode member, which are for use in another embodiment of the present invention.
Figure 13B:
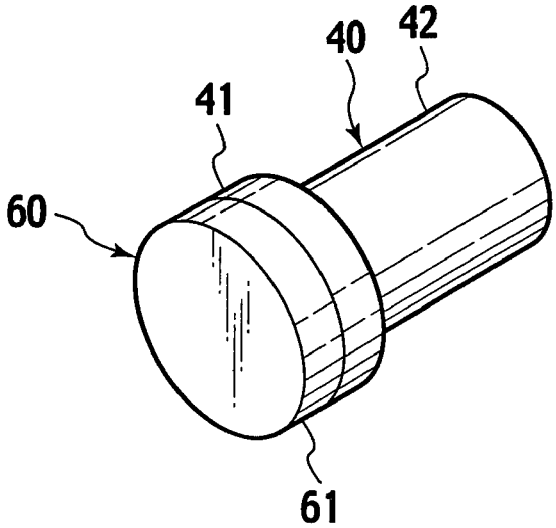

Moreover, as shown in FIG. 13A, a center hole 43 that is along an axial direction of an inner dielectric 40B is formed in the inner dielectric 40 concerned, and a metal-made electrode member 60 with a shape in which a large-diameter collar portion 61 is provided on an outer circumference of a small-diameter shaft portion 62 is prepared. Then, as shown in FIG. 13B, the shaft portion 62 of the electrode member 60 is fitted into the center hole 43 of the inner dielectric 40B in such a state where an outer circumferential surface of the shaft portion 62 is brought into intimate contact with an inner circumferential surface of the center hole 43. In such a way, the collar portion 61 of the electrode member 60 is superposed on the collar portion 41 of the inner dielectric 40B.

Figure 14A:
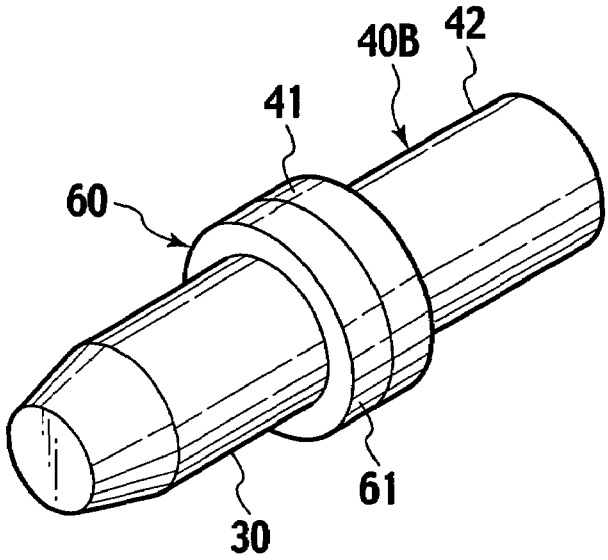
FIG. 14A is a perspective view showing a state where the electrode member and inner dielectric of FIGS. 13A and 13B and the inner terminal are assembled.
Figure 14B:
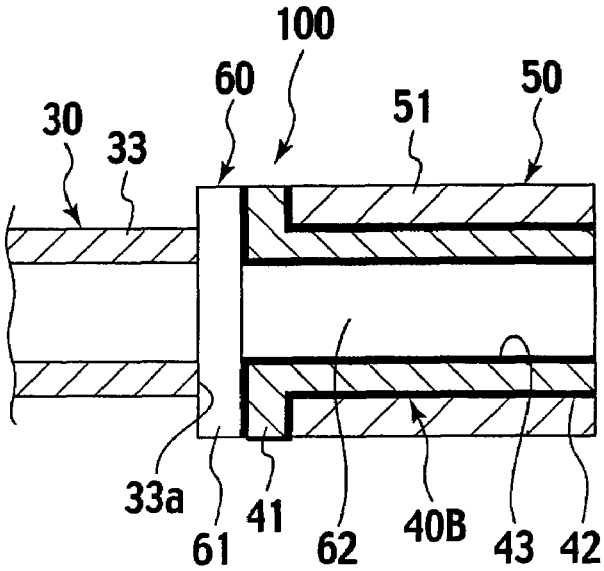
FIG. 14B is a cross-sectional view of a portion in which the capacitor function portion is composed by being incorporated into the connector.

Then, in this state, the tip end side of the core wire connection terminal 50 onto which the electrode member 60 and the inner dielectric 40 are attached is inserted into the holding hole 23 on the rear end of the insulator 20. Then, as shown in FIGS. 14A and 14B, the collar portion 41 of the inner dielectric 40B and the collar portion 61 of the electrode member 60 are sandwiched by the end surface 51*a* of the cylindrical portion 51 of the core wire connection terminal 50 and the end surface 33*a* of the cylindrical portion 33 as the rear end of the inner terminal 30. In such a way, contact surfaces of the electrode member 60 and the core wire connection terminal 50 with the inner dielectric 40*b* are used as the electrode surfaces, and the capacitor function portion 100 is composed of the inner dielectric 40B.

With such a configuration, contact areas between the inner dielectric 40B and the members which become the electrodes can be increased, and accordingly, the capacity of the capacitor can be enhanced. In this embodiment, the electrode member 60 and the cylindrical portion 33 are made to abut on each other; however, a conductive elastic member may be interposed therebetween as an integral body therewith or a separate body therefrom, or alternatively, a configuration in which a part of the electrode member is fitted into the inside of the cylindrical portion may be adopted.

Figure 15A:
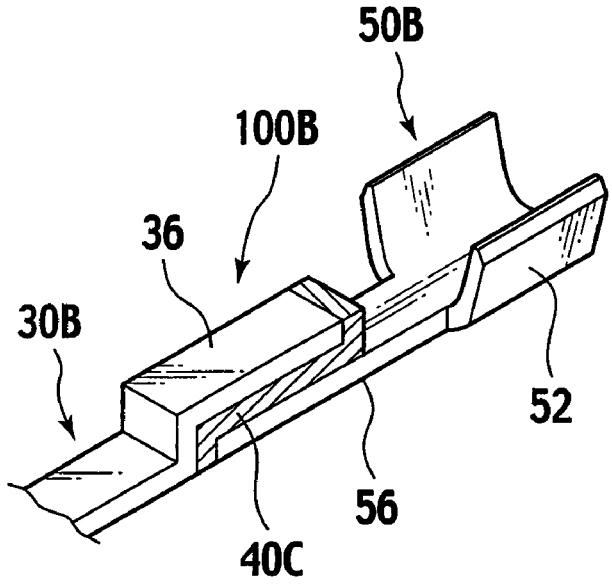
FIGS. 15A and 15B are views of a configuration of a main portion according to another embodiment of the present invention.
Figure 15B:
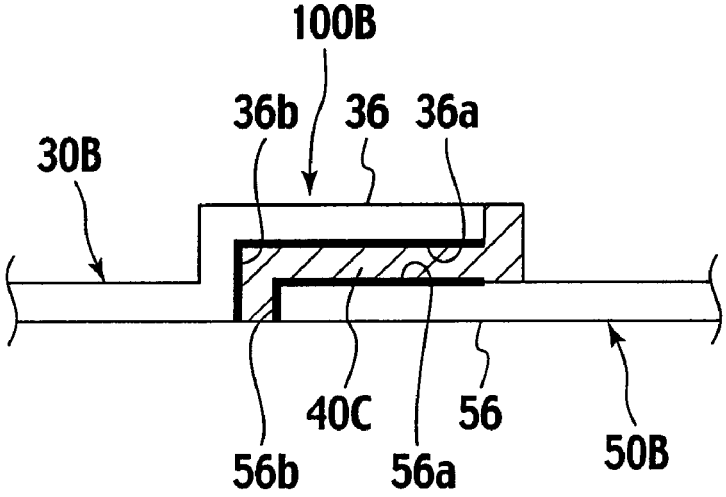

Moreover, in the above-described embodiment, the description has been made of the case where the capacitor function portion 100 is composed by making the inner dielectric 40 attached onto the tip end of the core wire connection terminal 50 abut on the rear end portion of the inner terminal 30. As another modification example, as shown in FIGS. 15A and 15B, a configuration may be adopted, in which plate portions 56 and 36 parallel to a connector fitting direction are formed on a tip end portion of a core wire connecting portion 50B and an inner terminal 30B, respectively, and an inner dielectric 40C is sandwiched between a plate surface 56*a* of the plate portion 56 and a plate surface 36*a* of the plate portion 36. Here, the plate surfaces 56*a* and 36*a* are substantially parallel to the connector fitting direction, and are opposite to each other.

In this case, the plate surfaces 56*a* and 36*a* which contact the inner dielectric 40C become opposite electrode surfaces, whereby a capacitor function portion 100B is composed of the inner dielectric 40C. Note that other opposite surfaces 36*b* and 56*b* which are opposite to each other while interposing the inner dielectric 40C therebetween also function as electrode surfaces.

Hence, it becomes possible to ensure large contact areas between the inner dielectric 40C and the core wire connection terminal 50B and between the inner dielectric 40C and the inner terminal 30B, whereby the capacity of the capacitor can be increased. Moreover, it becomes possible to easily calculate areas of such opposite electrodes, and accordingly, it becomes easy to calculate the capacity of the capacitor.

What is claimed is:

1. A coaxial connector with a built-in capacitor, comprising:

a core wire connection terminal having, on a rear end thereof, a core wire connection portion for connecting thereto a core wire of a coaxial cable;

an inner terminal having, on a tip end thereof, a fitted/connected portion fitted and connected to a mating terminal;

an insulator holding the inner terminal and covering an outer circumference of the inner terminal, and having a holding portion on a rear end of the insulator to hold the core wire connection terminal therein;

a shield terminal having, on a tip end thereof, a cylindrical shell portion that covers an outer circumference of the insulator and the core wire connection terminal, and on a rear end of the shield terminal having a shield conductor crimping portion for crimping and connecting thereto a shield conductor of the coaxial cable; and an inner dielectric that is sandwiched between and in contact with a tip end portion of the core wire connection terminal and a rear end portion of the inner terminal, and thereby composes a capacitor function portion while using, as opposite electrodes between the tip end portion of the core wire connection terminal and the rear end portion of the inner terminal;

wherein conductive films are formed on contact surfaces of the inner dielectric with members which become the electrodes.

2. The coaxial connector with a built-in capacitor according to claim 1, wherein surfaces of the inner dielectric, which contact the tip end portion of the core wire connection terminal and the rear end portion of the inner terminal, are formed as surfaces substantially parallel to a connector fitting direction.

3. A coaxial connector with a built-in capacitor, comprising, a core wire connection terminal having, on a rear end thereof, a core wire connection portion for connecting thereto a core wire of a coaxial cable;

an inner terminal having, on a tip end thereof, a fitted/connected portion fitted and connected to a mating terminal;

an insulator holding the inner terminal and covering an outer circumference of the inner terminal, and having a holding portion on a rear end of the insulator to hold the core wire connection terminal therein;

a shield terminal having, on a tip end thereof, a cylindrical shell portion that covers an outer circumference of the insulator and the core wire connection terminal, and on a rear end of the shield terminal having a shield conductor crimping portion for crimping and connecting thereto a shield conductor of the coaxial cable; and an inner dielectric that is sandwiched between a tip end portion of the core wire connection terminal and a rear end portion of the inner terminal, and thereby composes a capacitor function portion while using, as opposite electrodes between, the tip end portion of the core wire connection terminal and the rear end portion of the inner terminal, wherein the inner dielectric is attached onto the tip end of the core wire connection terminal, the core wire connection terminal is inserted into the holding portion of the insulator, and the inner dielectric provided on the tip end of the core wire connection terminal is made to abut on the rear end portion of the inner terminal, whereby the inner dielectric is sandwiched between the tip end portion of the core wire connection terminal and the rear end portion of the inner terminal, and opposite surfaces of the tip end portion of the core wire connection terminal and the rear end portion of the inner terminal, which are opposite to each other while interposing the inner dielectric therebetween, become electrode surfaces of the capacitor.

4. The coaxial connector with a built-in capacitor according to claim 3, wherein the inner dielectric forms a shape in which a large-diameter collar portion is provided on an outer circumference of a small-diameter shaft portion, the shaft portion is inserted into a cylindrical portion as the tip end of the core wire connecting terminal, whereby the inner dielectric is attached onto the tip end of the core wire connection terminal in a state where the collar portion is disposed on an end surface of the cylindrical portion, and the collar portion is sandwiched by the end surface of the cylindrical portion of the core wire connection terminal and an end surface of a cylindrical portion as the rear end of the inner terminal, whereby the capacitor function portion is composed of the inner dielectric while using the end surfaces of both of the cylindrical portions as the electrode surfaces.

5. The coaxial connector with a built-in capacitor according to claim 4, wherein a center hole that is along an axial direction of the inner dielectric is formed in the inner dielectric, a small-diameter shaft portion of a metal-made electrode member with a shape in which a large-diameter collar portion is provided on an outer circumference of the small-diameter shaft portion is fitted into the center hole in a state where the small-diameter shaft portion is brought into intimate contact with the center hole, the collar portion of the electrode member is superposed on the collar portion of the inner dielectric, and the collar portion of the inner dielectric and the collar portion of the electrode member are sandwiched by the end surface of the cylindrical portion of the core wire connection terminal and the end surface of the cylindrical portion as the rear end of the inner terminal in a state where the collar portion of the electrode member is superposed on the collar portion of the inner dielectric, whereby the capacitor function portion is composed of the inner dielectric while using, as the electrode surfaces, contact surfaces of the electrode member and the core wire connection terminal with the inner dielectric.

* * * * *

UNITED STATES PATENT AND TRADEMARK OFFICE

CERTIFICATE OF CORRECTION

PATENT NO. : 7,670,182 B2
APPLICATION NO. : 12/140040
DATED : March 2, 2010
INVENTOR(S) : Taishi Morikawa It is certified that error appears in the above-identified patent and that said Letters Patent is hereby corrected as shown below:

Claim 3, col. 8 , line 61, "electrodes between, the tip end portion of the core wire" should read -- electrodes between the tip end portion of the core wire --.

Signed and Sealed this

Twenty-second Day of June, 2010

David J. Kappos

David J. Kappos
*Director of the United States Patent and Trademark Office*